US006729047B2

(12) United States Patent
Hirayama

(10) Patent No.: US 6,729,047 B2
(45) Date of Patent: May 4, 2004

(54) STRAP ASSEMBLY FOR SPORT SHOE

(75) Inventor: Shuichi Hirayama, Sakai (JP)

(73) Assignee: Shimano Inc., Osaka (JP)

( * ) Notice: Subject to any disclaimer, the term of this patent is extended or adjusted under 35 U.S.C. 154(b) by 143 days.

(21) Appl. No.: 10/076,955

(22) Filed: Feb. 19, 2002

(65) Prior Publication Data

US 2003/0154631 A1 Aug. 21, 2003

(51) Int. Cl.[7] ..... A43B 5/04; A43B 5/16; A43C 11/00; A43C 11/12

(52) U.S. Cl. ..... 36/50.5; 36/117.1; 36/115; 24/68 SK; 24/71 SK; 24/70 SK

(58) Field of Search ..... 24/68 SK, 71 SK, 24/70 SK; 36/117.1, 50.5, 115

(56) References Cited

U.S. PATENT DOCUMENTS

| | | | | |
|---|---|---|---|---|
| 3,599,296 A | * | 8/1971 | Baso | 24/70 SK |
| 3,662,435 A | * | 5/1972 | Allsop | 24/70 SK |
| 6,076,848 A | | 6/2000 | Rigal et al. | |
| 6,250,651 B1 | * | 6/2001 | Reuss et al. | 24/70 SK |
| 6,253,467 B1 | | 7/2001 | Maravetz et al. | |
| 6,293,566 B1 | * | 9/2001 | Carpenter et al. | 36/50.5 |
| 6,446,362 B1 | * | 9/2002 | Martin et al. | 36/117.1 |
| 6,543,159 B1 | * | 4/2003 | Carpenter et al. | 36/117.1 |
| 6,554,297 B2 | * | 4/2003 | Phillips et al. | 24/68 SK |
| 6,604,746 B1 | * | 8/2003 | Sato et al. | 24/68 SK |

FOREIGN PATENT DOCUMENTS

| | | | |
|---|---|---|---|
| CH | 669311 A5 * | 3/1989 | A43B/5/04 |
| FR | 2 774 302 A1 | 8/1999 | |

OTHER PUBLICATIONS

K2 Snowboards Catalogue; 1998; Four (4) pages.

* cited by examiner

*Primary Examiner*—Anthony D. Stashick
(74) *Attorney, Agent, or Firm*—Shinjyu Global IP Counselors, LLP

(57) ABSTRACT

A sport shoe has a sole portion and an upper portion fixedly coupled to the sole portion. The upper portion has an inner side section, a center foot section and an outer side section. The first strap member has a first attachment portion coupled to one of the inner and outer side sections and a first pad connecting portion. The pad member has a first end portion, a center portion and a second end portion with the first pad connecting portion of the first strap member being fixedly coupled to the pad member by a fastening member. The adjustable strap buckle fixedly coupled to the first pad connecting portion of the first strap member by the fastening member. The second strap member has a second attachment portion coupled to the other of the inner and outer side sections and a second pad connecting portion that is adjustably coupled to the first strap member by the adjustable strap buckle.

30 Claims, 9 Drawing Sheets

STRAP ASSEMBLY FOR SPORT SHOE

BACKGROUND OF THE INVENTION

1. Field of the Invention

This invention generally relates to a strap assembly for a sport shoe. More specifically, the present invention relates to strap that provides a padding to the front ankle area of a sport shoe such as a snow board boot.

2. Background Information

In recent years, snowboarding has become a very popular winter sport. In fact, snowboarding was also an Olympic event during the winter games in 1998 at Nagano, Japan and in 2002 at Salt Lake City, United States. Snowboarding is similar to skiing in that a rider rides down a snow covered hill. The snowboard is generally shaped as a small surfboard or a large skateboard without wheels. The snowboarder stands on the snowboard with his or her feet generally transverse to the longitudinal axis of the snowboard. Similar to skiing, the snowboarder wears special boots, which are fixedly secured to the snowboard by a binding mechanism. In other words, unlike skiing, the snowboarder has both feet securely attached to a single snowboard with one foot positioned in front of the other foot. The snowboarder stands with both feet on the snowboard in a direction generally transverse to the longitudinal axis of the snowboard. Moreover, unlike skiing, the snowboarder does not utilize poles.

Snowboarding is a sport that involves balance and control of movement. When steering on a downhill slope, the snowboarder leans in various directions in order to control the direction of the movement of the snowboard. Specifically, as the snowboarder leans, the snowboarder movements must be transmitted from the boots to the snowboard in order to maintain control of the snowboard. For example, when a snowboarder leans backward, the movement causes the snowboard to tilt accordingly turning in the direction of the lean. Similarly, leaning forward causes the board to tilt in a corresponding manner and thus causing the snowboard to turn in that direction. Accordingly, the snowboard boots and bindings should be configured to maximize control over the snowboard.

Generally, snowboarding can be divided into alpine snowboarding and freestyle snowboarding. In alpine snowboarding, hard boots similar to those conventionally used for alpine skiing are worn, and fitted into so-called hard bindings mounted on the snowboard, which resemble alpine ski boot bindings. In freestyle snowboarding, soft boots similar to ordinary boots are typically worn. Of course, the soft style boots can also be in alpine snowboarding, if desired. Basically, there are many types of snowboard bindings that are currently available. However, snowboard bindings can be classified as either a step-in type binding or a strap type binding. Two examples of step-in type bindings are disclosed in U.S. Pat. No. 6,164,682 to Okajima, et al. and U.S. Pat. No. 6,325,405 to Okajima, et al. One example of a strap type binding is disclosed in U.S. Pat. No. 6,076,848 to Rigal et al.

There are step-in type bindings for hard snowboard boots and soft snowboard boots. When step-in type bindings are used with soft snowboard boots, an ankle strap assembly is used to prevent the heel of the snowboarder's foot from lifting within the boot. The ankle strap assembly is typically attached at medial and lateral attachment points on the boot and extends across the front portion of the ankle to hold the snowboarder's foot down in the bottom of the boot. A ratcheting mechanism is often used to tighten a first strap component coupled to one side of the boot with a second strap coupled to the other side of the boot. The ratcheting mechanism typically includes a ratcheting buckle mounted to one strap component, and a toothed strap component adapted to engage therewith. One example of such an ankle strap assembly is disclosed in U.S. Pat. No. 6,253,467 to Maravetz et al.

Similarly, ankle strap assemblies are also used in strap type bindings such as the one disclosed in U.S. Pat. No. 6,076,848 to Rigal et al. Thus, ankle straps in strap type bindings are usually attached directly to the sides of the binding.

Ankle strap assemblies in both step-in type bindings and strap type bindings are typically constructed out of many pieces. Thus, ankle strap assemblies typically have a relatively complex construction. These types of strap assembly are often relatively expensive to manufacture and assemble.

In view of the above, there exists a need for an improved ankle strap assembly which overcomes the above mentioned problems in the prior art. This invention addresses this need in the prior art as well as other needs, which will become apparent to those skilled in the art from this disclosure.

SUMMARY OF THE INVENTION

One object of the present invention is to provide a strap assembly that has a relatively simple construction.

Another object of the present invention is to provide a strap assembly that is relatively inexpensive to manufacture and assemble.

The foregoing objects can basically be attained by providing a strap assembly for a sport shoe in which the strap assembly includes a first strap member, a pad member, an adjustable strap buckle and a second strap member. The first strap member has a first attachment portion and a first pad connecting portion. The pad member has a first end portion, a center portion and a second end portion with the first pad connecting portion of the first strap member being fixedly coupled to the pad member by a fastening member. The adjustable strap buckle fixedly coupled to the first pad connecting portion of the first strap member by the fastening member. The second strap member has a second attachment portion and a second pad connecting portion that is adjustably coupled to the first strap member by the adjustable strap buckle.

The foregoing objects can basically be attained by providing a sport shoe having a sole portion and an upper portion fixedly coupled to the sole portion. The upper portion has an inner side section, a center foot section and an outer side section. The first strap member has a first attachment portion coupled to one of the inner and outer side sections and a first pad connecting portion. The pad member has a first end portion, a center portion and a second end portion with the first pad connecting portion of the first strap member being fixedly coupled to the pad member by a fastening member. The adjustable strap buckle fixedly coupled to the first pad connecting portion of the first strap member by the fastening member. The second strap member has a second attachment portion coupled to the other of the inner and outer side sections and a second pad connecting portion that is adjustably coupled to the first strap member by the adjustable strap buckle.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
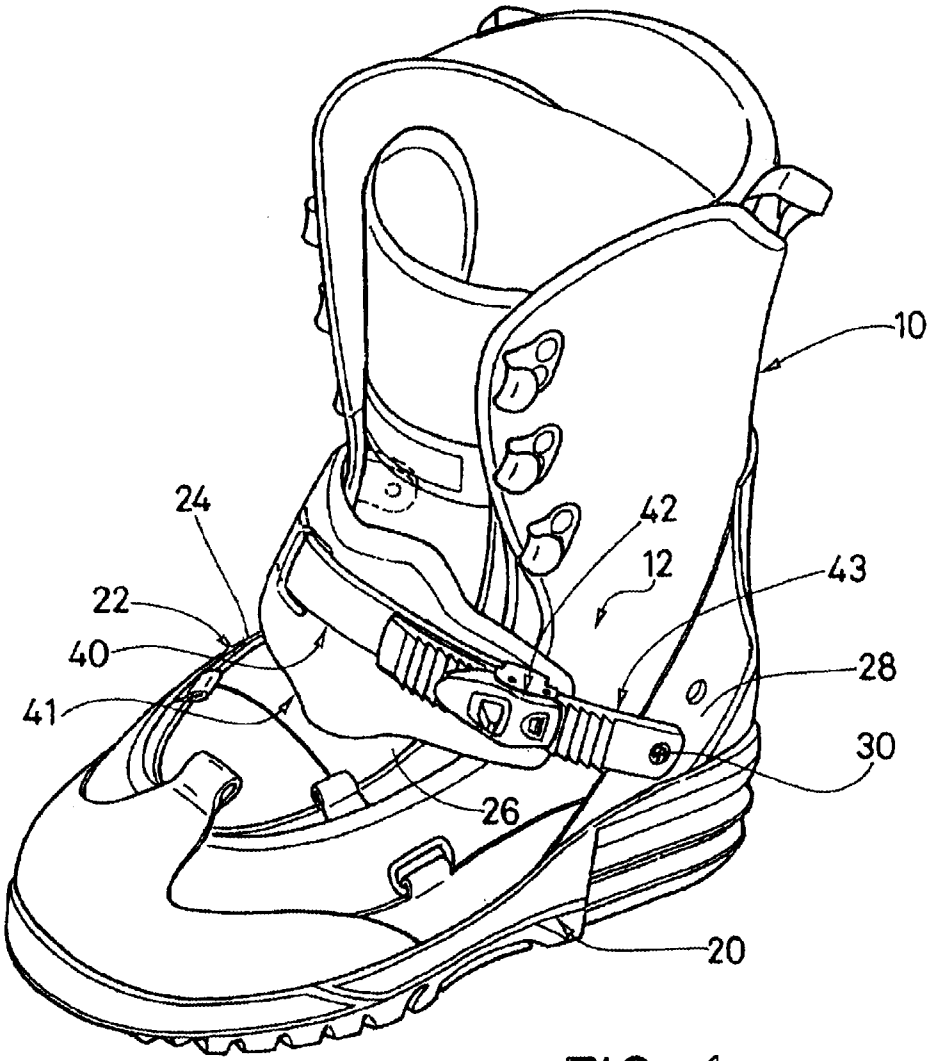
FIG. 1 is a side perspective view of a snowboard boot with a strap assembly in accordance with a first embodiment of the present invention.
Figure 2:
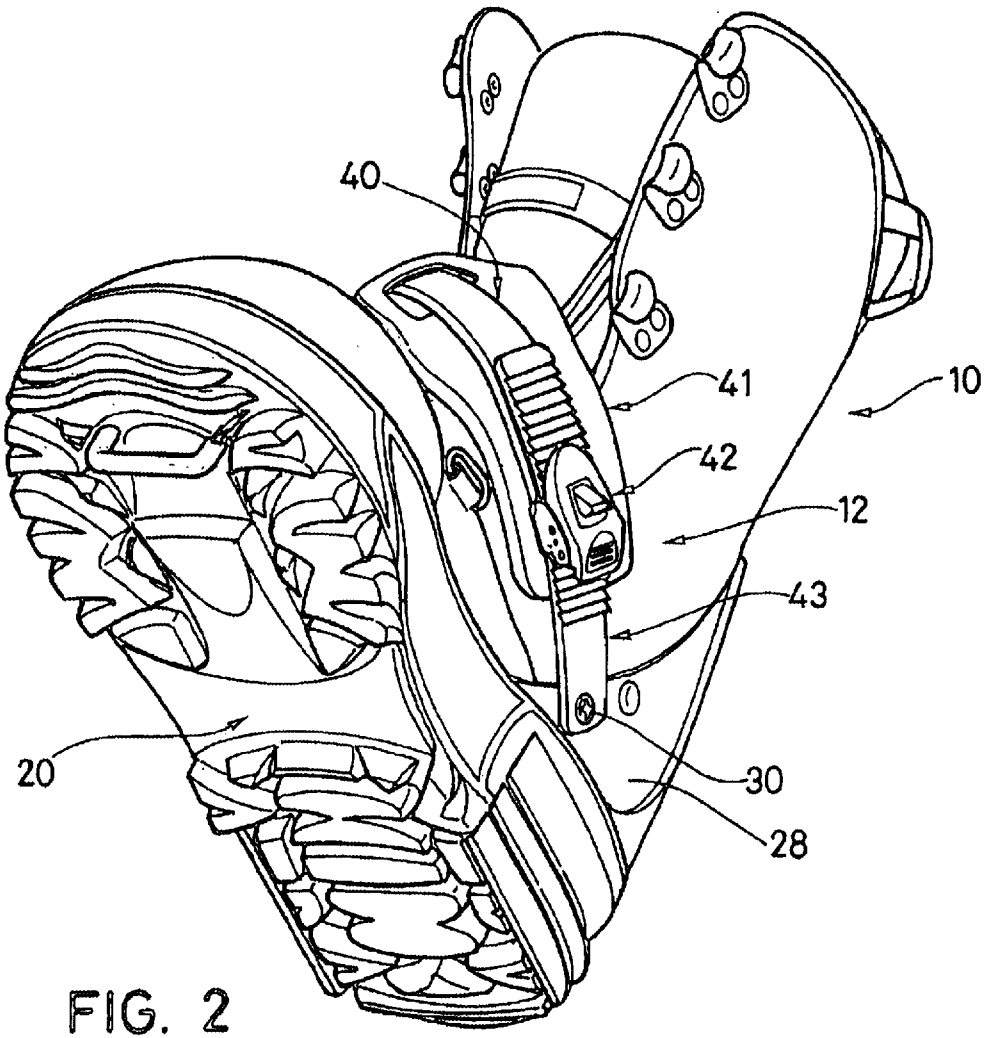
FIG. 2 is a bottom perspective view of the snowboard boot with the strap assembly illustrated in FIG. 1 in accordance with the first embodiment of the present invention.

Referring initially to FIGS. 1 and 2, a sport shoe such as a snowboard boot 10 with a strap assembly 12 is illustrated in accordance with a preferred embodiment of the present invention. The strap assembly 12 provides a tight fit around the ankle area of the wearer. While the strap assembly 12 is illustrated in use with the snowboard boot 10, it would be apparent to the one skilled in the art from this disclosure that the strap assembly 12 can be attached directly to a snowboard binding.

It would be apparent to the one skilled in the art from this disclosure that the strap assembly 12 can come in a variety of sizes to accommodate various sizes and shapes of sport shoes or snowboard boots or bindings.

As used herein, the following directional terms "forward, rearward, above, downward, vertical, horizontal, below and transverse" as well as any other similar directional terms refer to those directions of the snowboard boot 10 in the normal upright position. Accordingly, these terms, as utilized to describe the present invention should be interpreted relative to a wearer's foot with the snowboard boot 10 in the normal upright position.

Still referring to FIGS. 1 and 2, the snowboard boot 10 preferably has a sole portion 20, an upper portion 22 fixedly coupled to the sole portion 20 in a conventional manner. The upper portion 22 has an inner side section 24, a center foot section 26 and an outer side section 28. The snowboard boot 10 is configured to be used with a step-in or strapless binding system. Since snowboard boots such as snowboard boot 10 are well known in the art, snowboard boot 10 will not be discussed or illustrated in detail herein. In other words, the particular construction of the snowboard boot 10 is not important to the claimed invention. The inner side section 24 and the outer side section 28 of the snowboard boot 10 have a pair of fastening members 30 (only one shown) for coupling the strap assembly 12 thereto.

Figure 3:
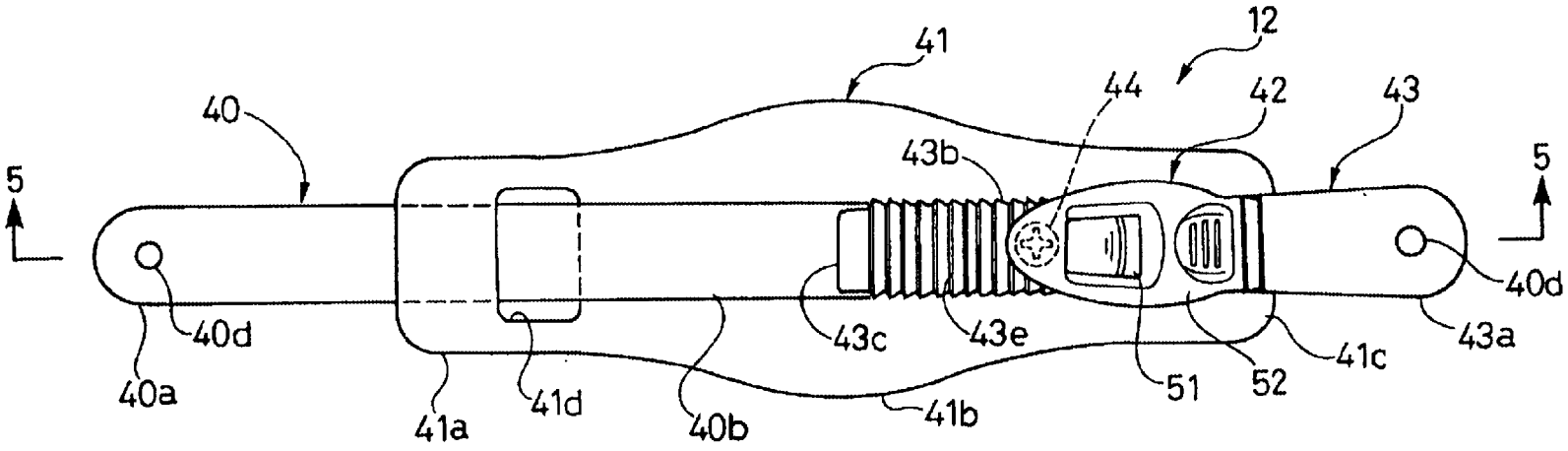
FIG. 3 is a top plan view of the strap assembly illustrated in FIGS. 1 and 2 in accordance with the first embodiment of the present invention.
Figure 4:
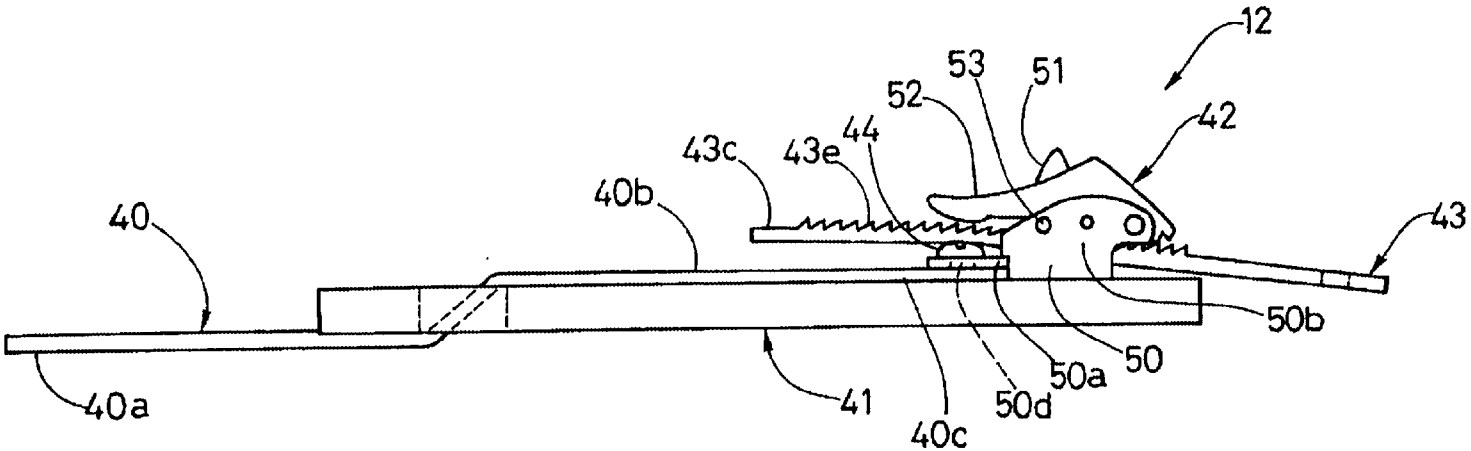
FIG. 4 is a side elevational view of the strap assembly illustrated in FIGS. 1–3 in accordance with the first embodiment of the present invention.
Figure 5:
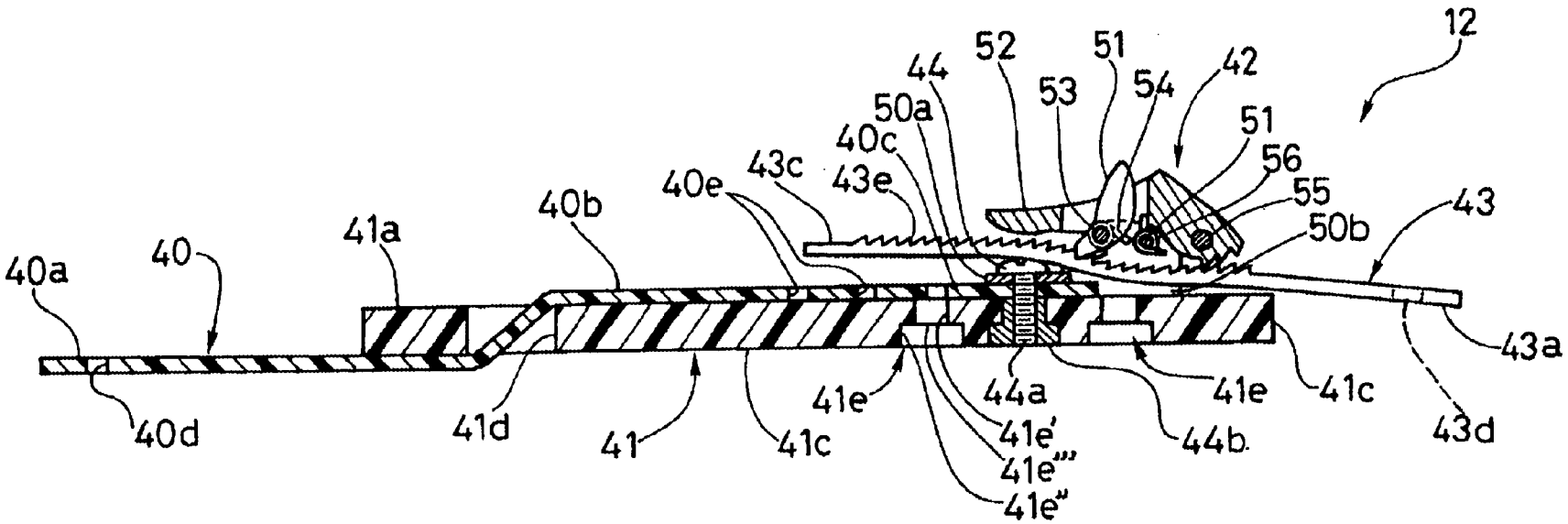
FIG. 5 is a longitudinal cross sectional view of the strap assembly illustrated in FIGS. 1–4 as seen along section line 5—5 of FIG. 3.

Referring now to FIGS. 3–5, the strap assembly 12 basically includes a first strap member 40, a pad member 41, an adjustable strap buckle 42 and a second strap member 43. A single fastening member 44 is utilized to couple the first strap member 40, the pad member 41 and the adjustable strap buckle 42 together. The second strap member 43 is adjustably coupled to the first strap member 40 and the pad member 41 by the adjustable strap buckle 42. Thus, the strap assembly 10 has relatively few parts and is relatively easy to manufacture and assemble.

Figure 6:
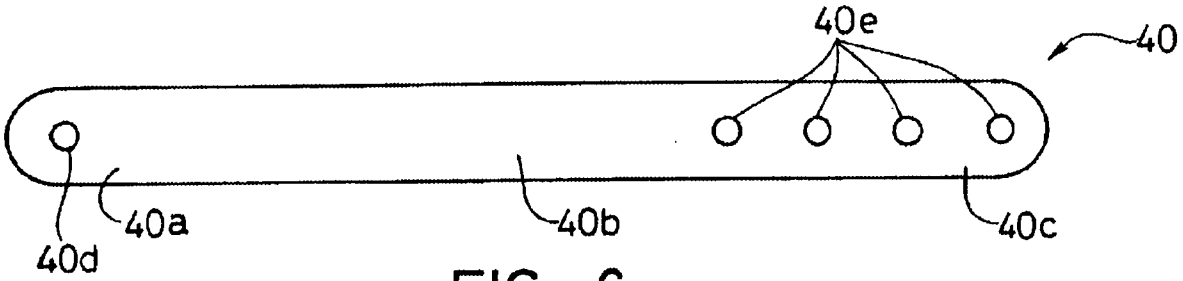
FIG. 6 is a top plan view of the first strap member of the strap assembly illustrated in FIGS. 1–5 in accordance with the first embodiment of the present invention.

Referring now to FIG. 6, the first strap member 40 is preferably a flexible elongated member that is a traction-resistant band. The first strap member 40 can be constructed out of any suitable material. For example, the first strap member 40 is preferably constructed of a flexible plastic material that does not normally stretch in the longitudinal or lengthwise direction during normal use.

The first strap member 40 has a first attachment portion 40*a*, a center portion 40*b* and a first pad connecting portion 40*c*. The first attachment portion 40*a* is coupled to one of the inner and outer side sections 24 and 28 of the boot 10 via the fasteners 30. In particular, the first attachment portion 40*a* has a through hole 40*d* for receiving the fastener 30 therethrough. The first pad connecting portion 40*c* is fixedly coupled to the pad member 41 and the adjustment strap buckle 42 via the fastening member 44. Specifically, the first pad connecting portion 40*c* has a plurality of adjustment holes 40*e* arranged in a lengthwise direction from the first pad connecting portion 40*c* of the first strap member 40 towards the first attachment portion 40*a* of the first attachment member 40 to selectively receive the fastening member 44 therein. Accordingly, the effective length of the first strap member 40 can be adjusted relative to the pad member 41 and the adjustable strap buckle 42.

As seen in FIGS. 3–5 and 7, the pad member 41 has a first end portion 41*a*, a center portion 41*b* and a second end portion 41*c*. The pad member 41 is preferably constructed as a one-piece, unitary member that is molded from a flexible, soft material that is compressible in the transverse direction to provide padding for the first and second strap members 40 and 43. For example, the pad member 41 can be constructed of a foam-type material. While the pad member 41 is shown as a single one-piece member, it will be apparent to those skilled in the art from this disclosure that the pad member 41 could be constructed of several layers of material. In any event, the material of the pad member 41 should have a sufficient thickness to be compressible in a transverse direction relative to the longitudinal axis of the pad member 41. As mentioned above, the pad member 41 is connected to the first pad connecting portion 40*c* of the first strap 40 via the fastening member 44. Moreover, the adjustable strap buckle 42 is also fixedly coupled to the second end portion 41*c* of the pad member 41 by the fastening member 44 as seen in FIG. 4.

The first end portion 41*a* preferably has a slot or opening 41*d* arranged and configured to receive a portion of the first strap member 40 therethrough. In other words, the first strap member 40 lies on top of the upper surface of the pad member 41 along the second end portion 41*c* and the center portion 41*b*, and then extends through the opening 41*d* such that the first strap member 40 overlies the bottom surface of the first end portion 41*a* of the pad member 41. The center portion 41*b* of the pad member 41 is preferably bowed outwardly at its lateral edges so that it is wider than the first and second end portions 41*a* and 41*c*, respectively. The second end portion 41*c* preferably has a plurality of adjustment or attachment holes 41*e* arranged in a lengthwise direction from the second end portion 41*c* of the pad member 41 towards the first end portion 41*a* of the pad member 41 to selectively receive the fastening member 44 therein. Accordingly, the location of the pad member 41 is adjustable in the lengthwise direction relative to the first strap member 40 by selecting one of the attachment holes 41*e*.

As best seen in FIG. 5, the attachment holes 41*e* are preferably step-shaped in the axial direction. In other words, each of the adjustment holes 41*e* has a small diameter portion 41*e*', a large diameter portion 41*e*" and an annular abutment surface 41*e*" formed between the small and large diameter portions 41*e*' and 41*e*". Thus, the adjustment holes 41*e* provide a recess for selectively receiving the fastener member 44 therein. In other words, the fastener member 44 is recessed within one of the attachment holes 41*e* so that the fastening member 44 is flush or recessed relative to the bottom surface of the pad member 41.

Referring again to FIGS. 3–5, the adjustable strap buckle 42 is fixedly coupled to the first strap member 40 and the pad member 41 by the fastening member 44. The adjustable strap buckle 42 is conventional component that is well known in the art. Since adjustable strap buckle are well known in the art, the adjustable strap buckle 42 will not be discussed or illustrated in detail herein. Of course, it will be apparent to those skilled in the art from this disclosure that other types of adjustable strap buckles can be used to carry out the present invention.

The adjustment strap buckle 42 basically includes a base member 50, a locking member or lever 51 and a tightening member or lever 52. The base member 50 is preferably a U-shaped member having a mounting section 50*a* and a pair of upwardly extending side sections 50*b*.

The mounting section 50*a* has a hole 50*d* for receiving the fastening member 44 therethrough to mount the adjustable strap buckle 42 to the first strap member 40 and the pad member 41. The side sections 50*b* of the adjustable strap buckle 42 pivotally supports the locking member 51 and the tightening member 52 thereon. More specifically, the locking member 51 is pivotally mounted on a pivot pin 53 extending perpendicularly between the side sections 50*b* of the adjustable strap buckle 42. A torsion spring 54 is mounted on the pivot pin 53 with one of the ends of the torsion spring 54 engaging an abutment or hole formed in the locking member 51 and the other end of the torsion spring 54 engaging an abutment or hole formed in one of the side sections 50*b* of the adjustable strap buckle 42. Thus, the locking member 51 is normally biased downwardly towards the mounting section 50*a* to selectively engage the second strap member 43.

The tightening member 52 is pivotally mounted on a pivot pin 55 extending substantially perpendicularly between the side sections 50*b* of the adjustable strap buckle 42. A torsion spring 56 is mounted on a pivot pin 57 with the coiled portion of the torsion spring 56 located on the shaft of the pivot pin 57. One end of the torsion spring 56 engages an abutment or hole formed in one of the side sections 50*b* of the adjustable strap buckle 42, while the other end of the torsion spring 56 engages an abutment or hole formed in the tightening member 52. Thus, the tightening member 52 is normally biased to a rest position as shown in FIG. 4 in which the tightening member 52 is normally spaced from the second strap member 43. When the tightening member 52 is pivoted about the axis of the pivot pin 55 in a clockwise direction, as shown in FIG. 4, the torsion spring 57 is compressed and the teeth of the tightening member 52 engage the second strap member 43 to move the second strap member 43 in a lengthwise direction.

Figure 7:
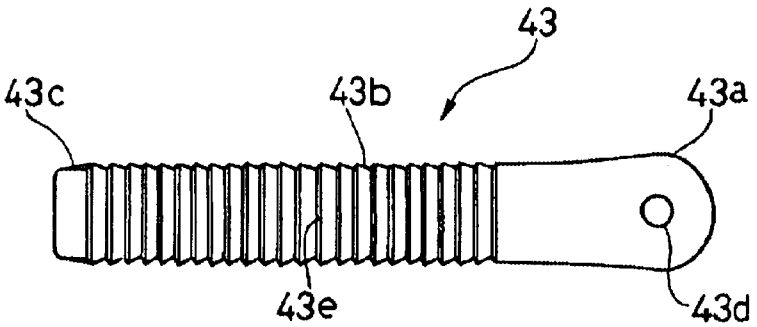
FIG. 7 is a top plan view of the second strap member of the strap assembly illustrated in FIGS. 1–5 in accordance with the first embodiment of the present invention.
Figure 8:
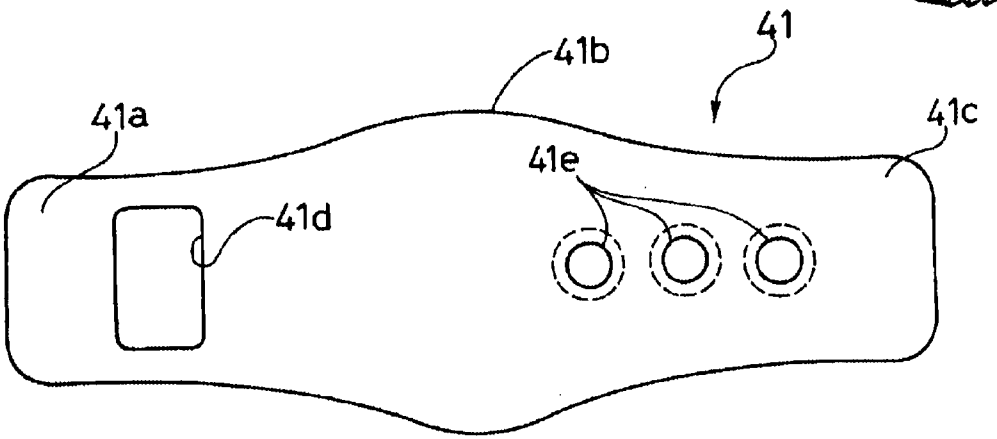
FIG. 8 is a top plan view of the pad member of the strap assembly illustrated in FIGS. 1–5 in accordance with the first embodiment of the present invention.
Figure 9:
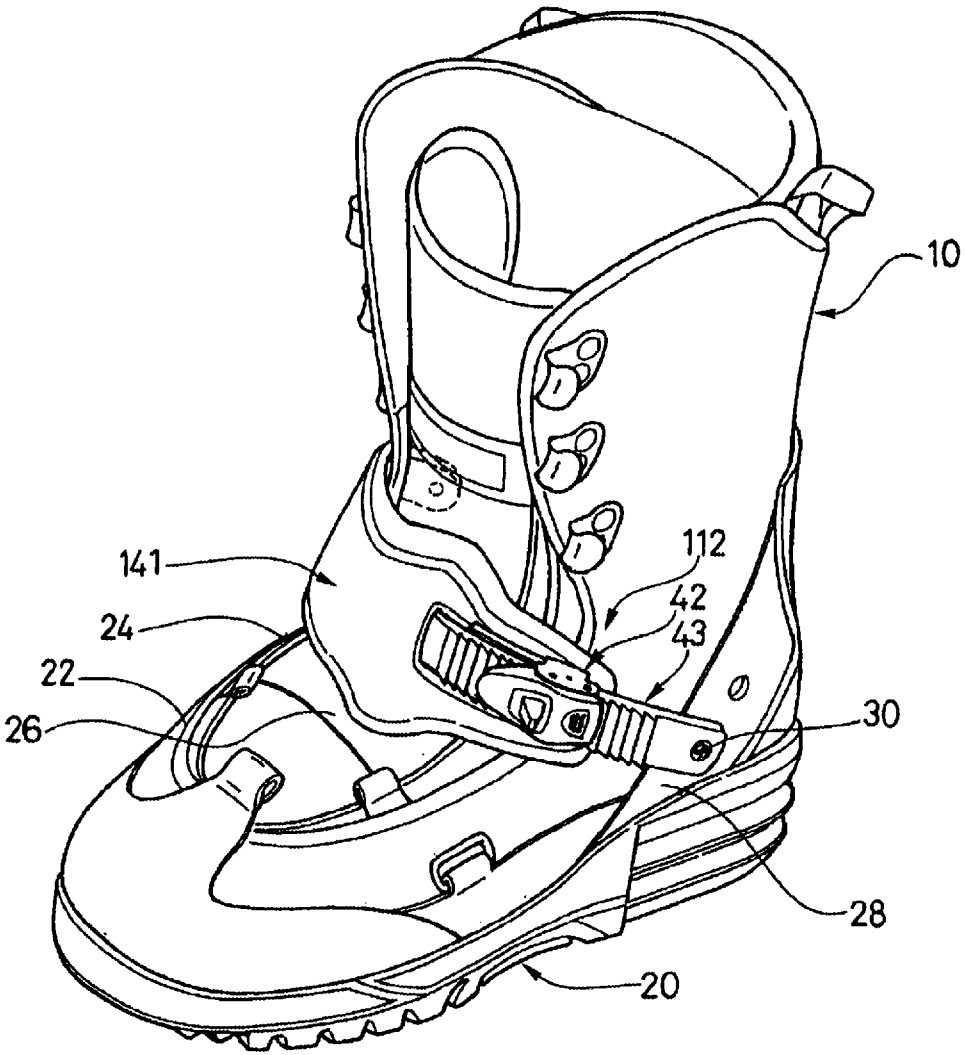
FIG. 9 is a perspective view of a snowboard boot with a strap assembly in accordance with a second embodiment of the present invention.
Figure 10:
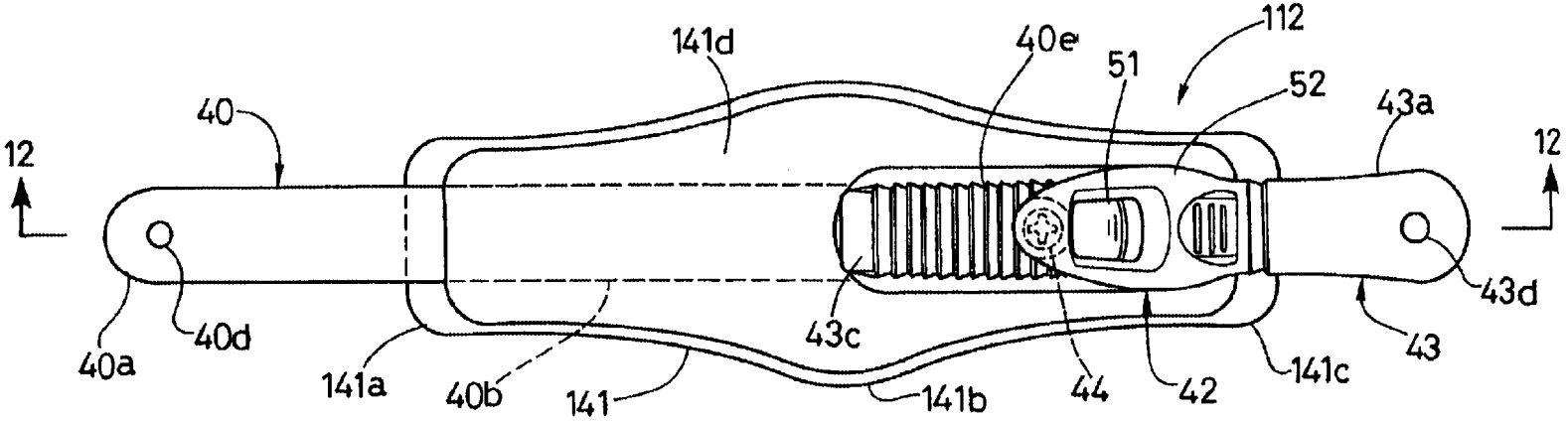
FIG. 10 is a top plan view of the strap assembly illustrated in FIG. 9 in accordance with the second embodiment of the present invention.
Figure 11:
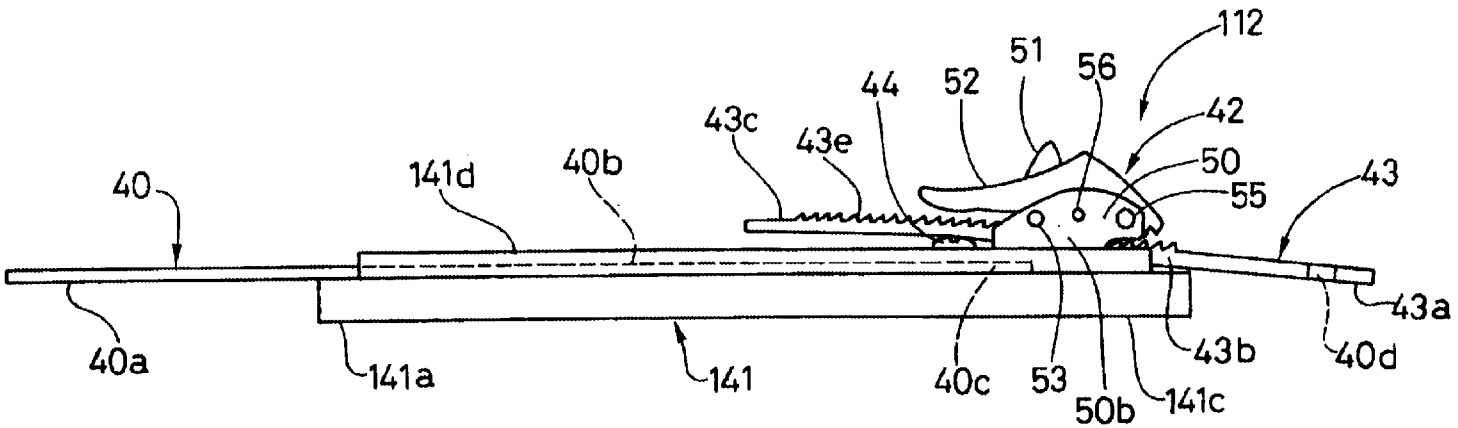
FIG. 11 is a side elevational view of the strap assembly illustrated in FIG. 10 in accordance with the second embodiment of the present invention.
Figure 12:
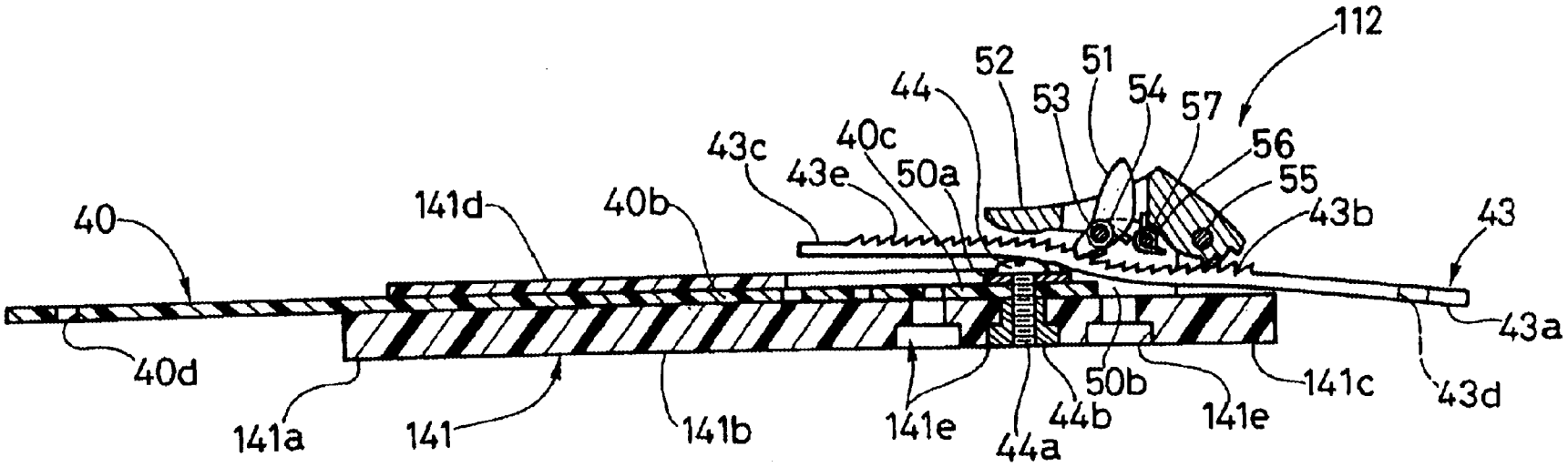
FIG. 12 is a longitudinal cross sectional view of the strap assembly illustrated in FIGS. 9–11 as seen along section line 12—12 of FIG. 10.
Figure 13:
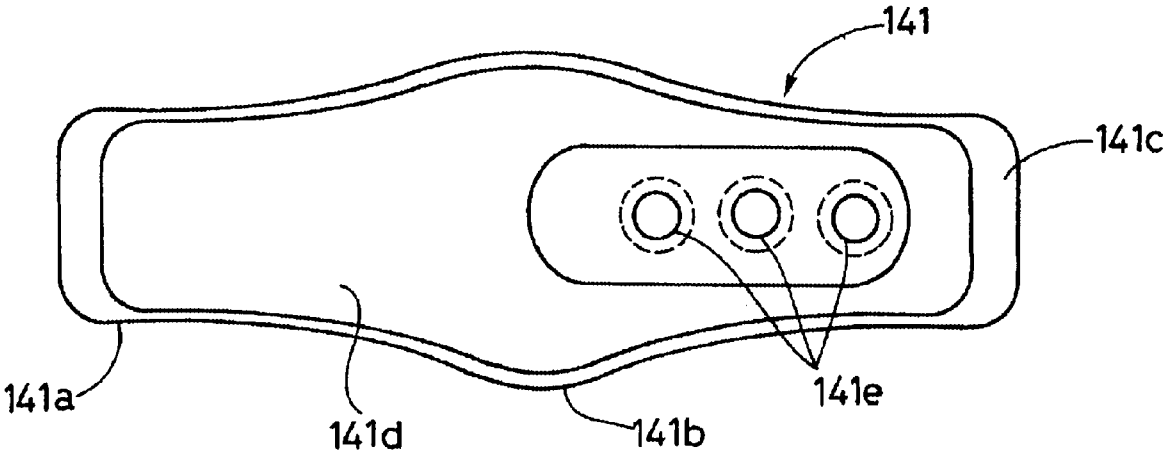
FIG. 13 is a top plan view of the pad member of the strap assembly illustrated in FIGS. 9–12 in accordance with the second embodiment of the present invention.
Figure 14:
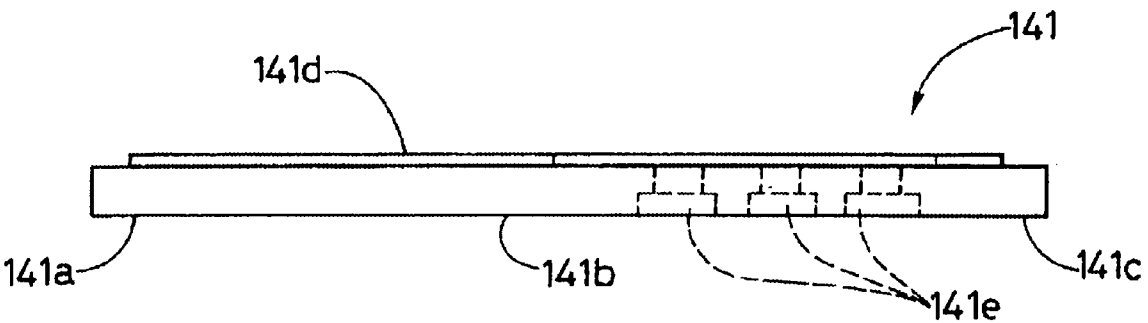
FIG. 14 is a side elevational view of the pad member illustrated in FIG. 13 in accordance with the second embodiment of the present invention.

As best seen in FIG. 7, the second strap member 43 is preferably a flexible traction-resistant band. The second strap member 43 can be constructed of any suitable material. For example, the second strap member 43 is preferably of a flexible plastic material that does not normally stretch in the longitudinal or lengthwise direction during normal use. The second strap member 43 has a second attachment portion 43*a*, a center portion 43*b* and a second pad connecting portion 43*c*. The second attachment portion 43*a* is coupled to one of the inner and outer side sections 24 and 28 of the snowboard boot 10. Preferably, the second attachment portion 43*a* has a hole 43*d* for receiving the fastener 30 that couples the second attachment portion 43*a* to the snowboard boot 10. The center portion 43*b* and the second pad connecting portion 43*c* are serrated in a lengthwise direction to form a plurality of teeth 43*e*. Each of the serrations or teeth 43*e* of the second strap member 43 includes a locking surface extending substantially perpendicularly from the upper surface of the second strap member 43 and a ramp surface extending upwardly and away from the second attachment portion 43*a* of the second strap member 43. Accordingly, the serrations or teeth 43*e* of the center portion 43*b* and the second pad connecting portion 43*c* form ratchet teeth that selectively engage the locking member 51 of the adjustable strap buckle 42. In other words, the second strap member 43 can be adjusted in the lengthwise direction relative to the first strap member 40 and the pad member 41 by the adjustable strap buckle 42. More specifically, the tightening member 52 of the adjustable strap buckle 42 is rotated in a clockwise direction as seen in FIG. 4 so that the teeth of the tightening member 52 engage the teeth or serrations 43*e* of the second strap member 43 to move the second strap member 43 in a lengthwise direction relative to the first strap member 40 and the pad member 41.

The fastening member 44 preferably includes a bolt 44*a* and a nut 44*b* so that the strap assembly 12 can be adjusted as previously explained. Of course, it will be apparent to those skilled in the art from this disclosure that a non-removable fastening member (e.g., a rivet) can be used to carry out a less preferred embodiment of the present invention. Thus, the term "removable" as used herein mean that the part or parts are constructed to be separated without breaking or damaging any part or parts of the strap assembly 12. The nut 44*b* is a threaded T-nut that is at least partially disposed in the attachment holes 41*e* of the pad member 41. The bolt 44*a* has a threaded shaft that mates with the nut 44*b*.

Second Embodiment

Referring now to FIGS. 9–14, a strap assembly 112 is illustrated in accordance with a second embodiment of the present invention. Basically, the strap assembly 112 is identical to strap assembly 12, except for the pad member 41 of the first embodiment has been replaced with the pad member 141 of the second embodiment. In view of the similarity between the first and second embodiments, the parts of the second embodiment that are identical to the parts of the first embodiment will be given the same reference numerals as the parts of the first embodiment. In other words, the strap assembly 112 uses the first strap member 40, the adjustable strap buckle 42, the second strap member 43 and the fastening member 44 of the first embodiment. Thus, the descriptions of the parts of the second embodiment that are identical to the parts of the first embodiment may be omitted for the sake of brevity.

As seen in FIGS. 10–14, the pad member 141 has a first end portion 141*a*, a center portion 141*b*, a second end portion 141*c* and a pocket member 141*d*. The pad member 141 is preferably constructed of as a one-piece, unitary member that is molded from a flexible, soft material that is compressible in the transverse direction. For example, the pad member 141 can be constructed of a foam-type material. While the pad member 141 is shown as a single one-piece member, it will be apparent to those skilled in the art from this disclosure that the pad member 141 could be constructed of several layers of material. In any event, the material of the pad member 141 should be compressible in a transverse direction relative to the longitudinal axis of the pad member 141. As mentioned above, the pad member 141 is connected to the first pad connecting portion 40*c* of the first strap 40 via the fastening member 44. Moreover, the adjustable strap buckle 42 is also fixedly coupled to the second end portion 141*c* of the pad member 141 by the fastening member 44.

The pocket member 141*d* overlies the upper surface of the portions 141*a*–141*c* to form a longitudinal tunnel or slot that is arranged and configured to receive the center portion 40*b* of the first strap member 40 therethrough. In other words, the first strap member 40 lies in between the upper surface of the portions 141*a*–141*c* and the pocket member 141*d*.

The second end portion 141*c* preferably has a plurality of adjustment holes 141*e* arranged in a lengthwise direction from the second end portion 141*c* of the pad member 141 towards the first end portion 141*a* of the pad member 141 to selectively receive the fastening member 44 therein. Accordingly, the location of the pad member 141 is adjustable in the lengthwise direction relative to the first strap member 40 by selecting one of the attachment holes 141*e*. The attachment holes 141*e* are preferably step-shaped in the axial direction as in the first embodiment. In other words, the fastener member 44 is recessed within one of the attachment holes 141*e* so that the fastening member 44 is flush or recessed relative to the bottom surface of the pad member 141.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A strap assembly for a sport shoe, comprising:

a first strap member having a first attachment portion and a first pad connecting portion;

a pad member having a first end portion, a center portion and a second end portion with said first pad connecting portion of said first strap member being fixedly coupled to said pad member by a fastening member;

an adjustable strap buckle fixedly coupled to said first pad connecting portion of said first strap member by said fastening member; and a second strap member having a second attachment portion and a second pad connecting portion that is adjustably coupled to said first strap member by said adjustable strap buckle.

2. The strap assembly according to claim 1, wherein said first pad connecting portion extends from said first end portion of said pad member across said center portion of said pad member to said second end portion of said pad member where said first strap member is fixedly coupled to said second end portion of said pad member by said fastening member.

3. The strap assembly according to claim 1, wherein said fastening member includes a bolt and nut.

4. The strap assembly according to claim 3, wherein said bolt has a threaded shaft extending through axially aligned holes formed in said first strap member, said pad member and said adjustable strap buckle, respectively.

5. The strap assembly according to claim 4, wherein said nut is at least partially recessed within said pad member.

6. The strap assembly according to claim 1, wherein said first attachment portion of said first strap member has at least one attachment hole.

7. The strap assembly according to claim 6, wherein said first pad connecting portion of said first strap member has a plurality of adjustment holes arranged in a length-wise direction of said first strap member between said first attachment portion and said first pad connecting portion.

8. The strap assembly according to claim 7, wherein said second attachment portion of said second strap member has at least one attachment hole.

9. The strap assembly according to claim 8, wherein said second pad connecting portion of said second strap member is serrated in a length-wise direction of said second strap member, and said adjustable strap buckle is an incremental latching buckle with a lever biased to a latching position.

10. The strap assembly according to claim 1, wherein said first pad connecting portion of said first strap member has a plurality of adjustment holes arranged in a length-wise direction from said first pad connecting portion towards said first attachment portion to selectively receive said fastening member.

11. The strap assembly according to claim 1, wherein said second attachment portion of said second strap member has at least one attachment hole.

12. The strap assembly according to claim 1, wherein said second pad connecting portion of said second strap member is serrated in a length-wise direction of said second strap member, and said adjustable strap buckle is an incremental latching buckle with a lever biased to a latching position.

13. The strap assembly according to claim 1, wherein said first end portion of said pad member has an opening arranged and configured with said first strap member located therein.

14. The strap assembly according to claim 1, wherein said pad member has a base part and a looped part coupled to said base part, said first pad connecting portion of said first strap member being fixedly coupled to said base part by said fastening member and an intermediate portion of said first strap member being located in said looped part.

15. The strap assembly according to claim 1, wherein said second end portion of said pad member has a plurality of adjustment holes arranged in a length-wise direction from said second end portion of said pad member towards said first end portion of said pad member to selectively receive said fastening member.

16. A sport shoe comprising:

a sole portion;

an upper portion fixedly coupled to said sole portion, said upper portion having an inner side section, a center foot section and an outer side section;

a first strap member having a first attachment portion coupled to one of said inner and outer side sections and a first pad connecting portion;

a pad member having a first end portion, a center portion and a second end portion with said first pad connecting portion of said first strap member being fixedly coupled to said pad member by a fastening member;

an adjustable strap buckle fixedly coupled to said first pad connecting portion of said first strap member by said fastening member; and a second strap member having a second attachment portion coupled to the other of said inner and outer side sections and a second pad connecting portion that is adjustably coupled to said first strap member by said adjustable strap buckle.

17. The sport shoe according to claim 16, wherein said first pad connecting portion extends from said first end portion of said pad member across said center portion of said pad member to said second end portion of said pad member where said first strap member is fixedly coupled to said second end portion of said pad member by said fastening member.

18. The sport shoe according to claim 16, wherein said fastening member includes a bolt and nut.

19. The sport shoe according to claim 18, wherein said bolt has a threaded shaft extending through axially aligned holes formed in said first strap member, said pad member and said adjustable strap buckle, respectively.

20. The sport shoe according to claim 19, wherein said nut is at least partially recessed within said pad member.

21. The sport shoe according to claim 16, wherein said first attachment portion of said first strap member has at least one attachment hole.

22. The sport shoe according to claim 21, wherein said first pad connecting portion of said first strap member has a plurality of adjustment holes arranged in a length-wise direction of said first strap member between said first attachment portion and said first pad connecting portion.

23. The sport shoe according to claim 22, wherein said second attachment portion of said second strap member has at least one attachment hole.

24. The sport shoe according to claim 23, wherein said second pad connecting portion of said second strap member is serrated in a length-wise direction of said second strap member, and said adjustable strap buckle is an incremental latching buckle with a lever biased to a latching position.

25. The sport shoe according to claim 16, wherein said first pad connecting portion of said first strap member has a plurality of adjustment holes arranged in a length-wise direction from said first pad connecting portion towards said first attachment portion to selectively receive said fastening member.

26. The sport shoe according to claim 16, wherein said second attachment portion of said second strap member has at least one attachment hole.

27. The sport shoe according to claim 16, wherein said second pad connecting portion of said second strap member is serrated in a length-wise direction of said second strap member, and said adjustable strap buckle is an incremental latching buckle with a lever biased to a latching position.

28. The sport shoe according to claim 16, wherein said first end portion of said pad member has an opening arranged and configured with said first strap member located therein.

29. The sport shoe according to claim 16, wherein said pad member has a base part and a looped part coupled to said base part, said first pad connecting portion of said first strap member being fixedly coupled to said base part by said fastening member and an intermediate portion of said first strap member being located in said looped part.

30. The sport shoe according to claim 16, wherein said second end portion of said pad member has a plurality of adjustment holes arranged in a length-wise direction from said second end portion of said pad member towards said first end portion of said pad member to selectively receive said fastening member.

* * * * *